US007932866B2

(12) United States Patent
Huang et al.

(10) Patent No.: US 7,932,866 B2
(45) Date of Patent: Apr. 26, 2011

(54) ANTENNA

(75) Inventors: Jiunn-Ming Huang, Taipei (TW); Shen-Pin Wei, Taipei (TW); Yuan-Li Chang, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 44 days.

(21) Appl. No.: 12/492,002

(22) Filed: Jun. 25, 2009

(65) Prior Publication Data

US 2009/0256772 A1 Oct. 15, 2009

Related U.S. Application Data

(63) Continuation of application No. 11/769,638, filed on Jun. 27, 2007, now Pat. No. 7,646,342.

(30) Foreign Application Priority Data

Oct. 31, 2006 (TW) ..... 95140196 A

(51) Int. Cl.
*H01Q 1/24* (2006.01)
*H01Q 1/38* (2006.01)

(52) U.S. Cl. ..... 343/702; 343/700 MS; 343/846

(58) Field of Classification Search ..... 343/700 MS, 343/702, 895, 725, 846
See application file for complete search history.

(56) References Cited

U.S. PATENT DOCUMENTS

| | | | | |
|---|---|---|---|---|
| 6,147,652 | A | 11/2000 | Sekine | |
| 6,812,892 | B2 * | 11/2004 | Tai et al. | 343/700 MS |
| 6,891,504 | B2 | 5/2005 | Cheng et al. | |
| 6,930,641 | B2 | 8/2005 | Ohara et al. | |
| 7,298,334 | B2 * | 11/2007 | Fang et al. | 343/700 MS |

FOREIGN PATENT DOCUMENTS

| | | |
|---|---|---|
| CN | 1441980 A | 9/2003 |
| CN | 1492540 A | 4/2004 |
| TW | I227576 | 2/2005 |

OTHER PUBLICATIONS

China Patent Office, Office Action, Patent Application Serial No. 200610143539.8, Dec. 21, 2010, China.

* cited by examiner

*Primary Examiner* — Hoang V Nguyen

(57) ABSTRACT

An antenna comprises a first transmission element, a second transmission element, a conductive element, a ground element, a ground line and a signal line. The conductive element is connected to the ground element. The first transmission element is connected to the conductive element. The first transmission element comprises a first spiral structure and a first axis. The second transmission element is connected to the conductive element. The ground line is electrically connected to the ground element. The signal line is electrically connected to the conductive element at a feed point.

14 Claims, 10 Drawing Sheets

ANTENNA

This application is a continuation of U.S. application Ser. No. 11/769,638, filed Jun. 27, 2007, the entire disclosure of which is hereby incorporated by reference.

BACKGROUND OF THE INVENTION

1. Field of the Invention

The invention relates to an antenna, and more particularly to an inverse F antenna comprising spiral structure.

2. Description of the Related Art

FIG. 1 shows a conventional antenna 10 comprising a ground element 1, a conductive element 2, a transmission element 3, and a coaxial cable 4. The conductive element 2 is connected to the ground element 1. The transmission element 3 is connected to the conductive element 2. The coaxial cable 4 is electrically connected to the ground element 1 and the conductive element 2.

Conventionally, the length of the transmission element 3 is determined according to the wavelength of the wireless signal transmitted by the antenna 1. The length of the transmission element 3 thus cannot be reduced. As well, the conventional antenna 10 requires additional a matching element to modify impedance thereof, and volume of the antenna 10 is increased.

BRIEF SUMMARY OF THE INVENTION

A detailed description is given in the following embodiments with reference to the accompanying drawings.

The invention provides an antenna comprising a first transmission element, a second transmission element, a conductive element, a ground element, a ground line and a signal line. The conductive element is connected to the ground element. The first transmission element is connected to the conductive element. The first transmission element comprises a first spiral structure and a first axis. The second transmission element is connected to the conductive element. The ground line is electrically connected to the ground element. The signal line is electrically connected to the conductive element at a feed point.

The embodiment provides an antenna of reduced size and improved transmission.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
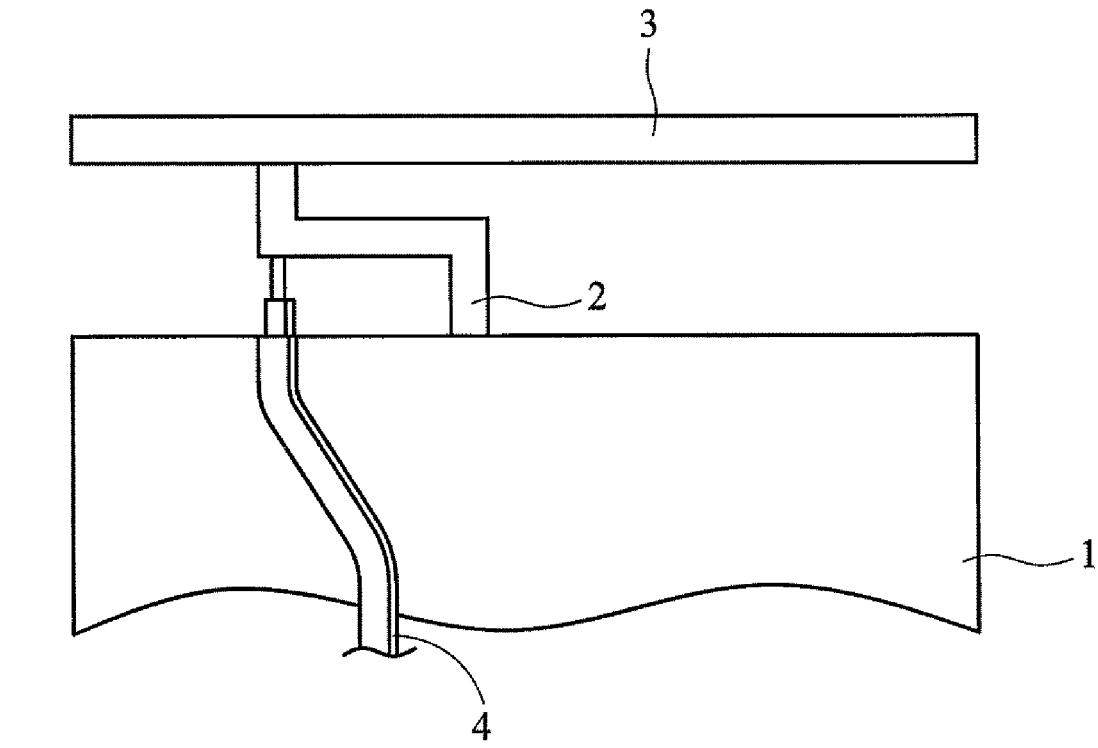
FIG. 1 ( PRIOR ART )
FIG. 1 shows a conventional antenna.
Figure 2A:
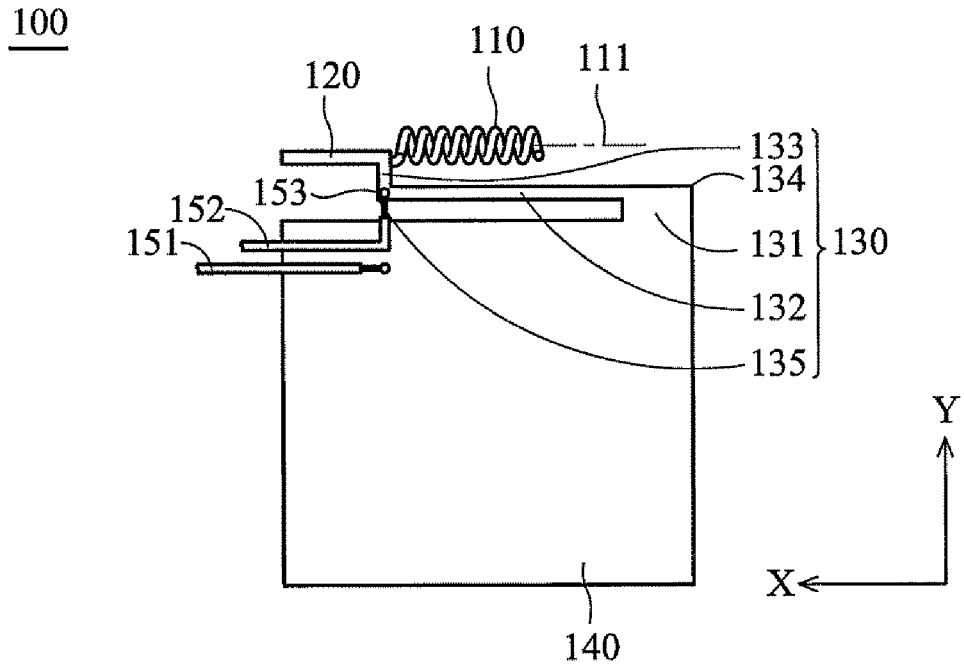
FIGS. 2*a* and 2*b* show an antenna of a first embodiment.
Figure 2B:
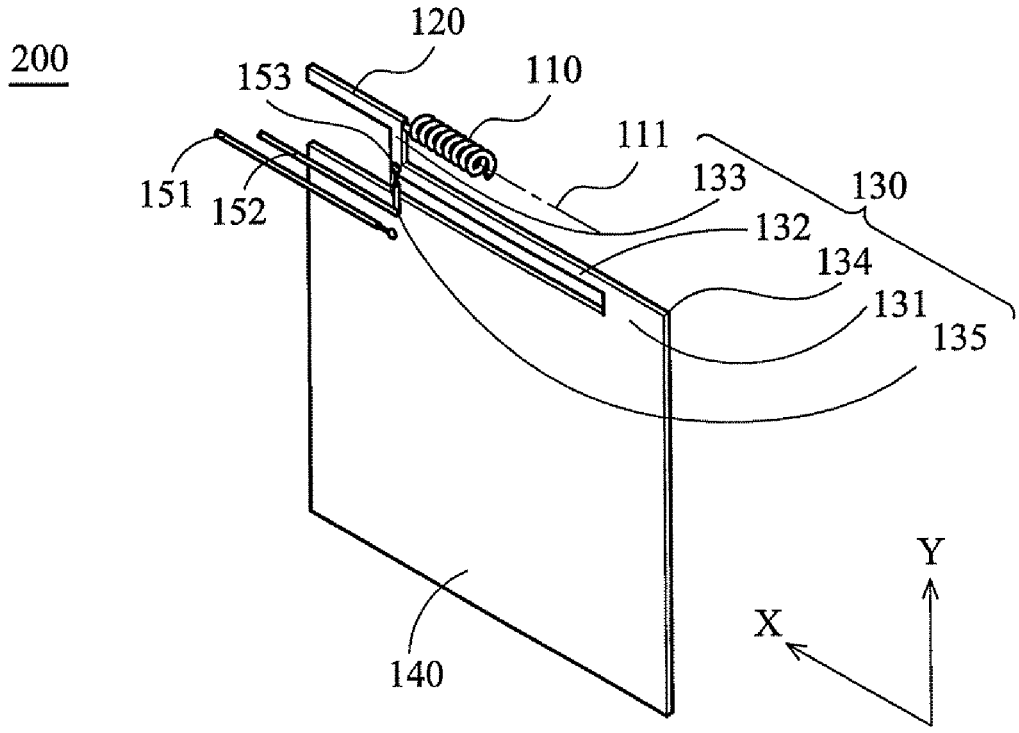

FIGS. 2*a* and 2*b* show an antenna 100 of a first embodiment, which is an inverse F antenna. The antenna 100 comprises a first transmission element 110, a second transmission element 120, a conductive element 130, a ground element 140, a ground line 151, and a signal line 152. The conductive element 130 comprises a first section 131, a second section 132, a third section 133, a first angled portion 134 and a second angled portion 135. The first section 131 is connected to the ground element 140. The first angled portion 134 connects the second section 132 and the first section 131. The second angled portion 135 connects the third section 133 and the second section 132. The first section 131 and the third section 133 extend in a first direction Y. The second section 132 extends in a second direction X. The first direction Y is perpendicular to the second direction X. The first transmission element 110 is connected to the third portion 133 comprising a first spiral structure and a first axis 111. The first axis 111 extends in a third direction −X. The second transmission element 120 is connected to the third section 133. The second transmission element 120 extends in the second direction X. The ground line 151 is electrically connected to the ground element 140. The signal line 152 is electrically connected to the conductive element 130 on a feed point 153. In the first embodiment, the feed point 153 is located on the second angled portion 135 between the second section 132 and the third section 133. However, the feed point 153 can be located elsewhere on the second section 132 or the third section 133.

The first transmission element 110 comprises a first spiral structure to decrease the length of the first transmission element 110 and the size of the antenna 100.

Figure 3A:
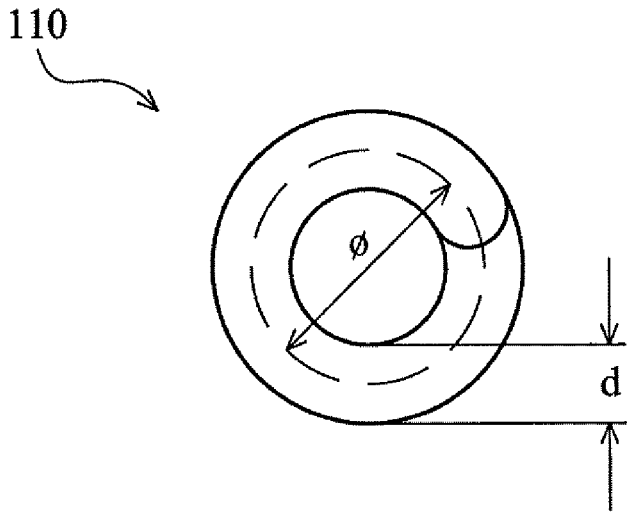
FIG. 3*a* is a front view of a first transmission element.
Figure 3B:
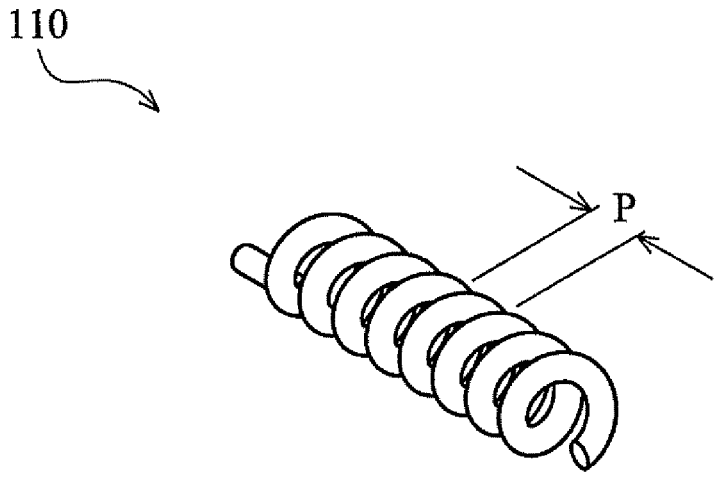
FIG. 3*b* is a perspective view of a first transmission element.

FIG. 3 is a front view of the first transmission element 110, and FIG. 3*b* is a perspective view of the first transmission element 110. The first spiral structure of the first transmission element 110 comprises a wire diameter d, a thread diameter $\phi$, a thread pitch P and a thread number $N_1$ (not shown). The impedance matching of the antenna 100 can be modified by changing the wire diameter d, the thread diameter $\phi$, the thread pitch P and the thread number $N_1$. Additionally, the bandwidth of the first transmission element 110 can be modified via changing the wire diameter d.

Figure 4:
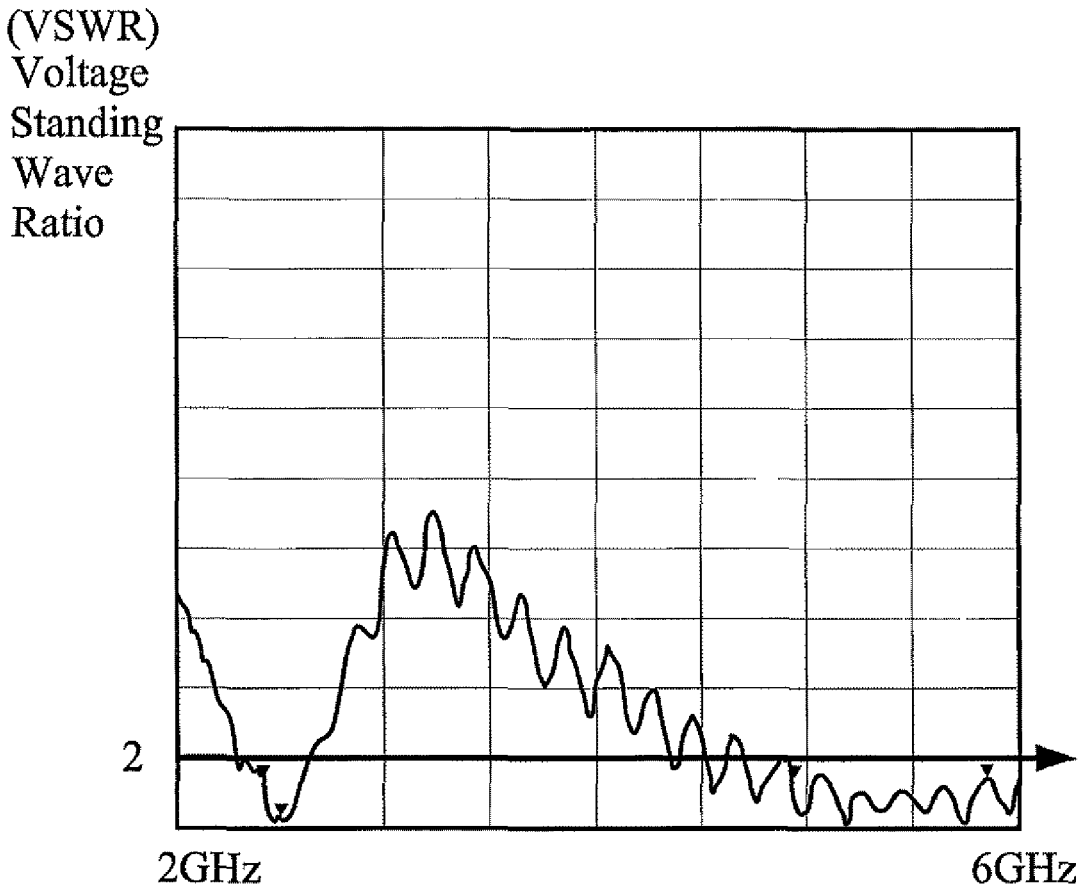
FIG. 4 shows the transmission of a first embodiment.

In the first embodiment, the wire diameter d is 0.5 mm, the thread diameter $\phi$ is 2 mm, the thread pitch P is 1 mm, and the thread number $N_1$ is 8. FIG. 4 shows the transmission of the antenna 100 of the first embodiment. The antenna 100 has Voltage Standing Wave Ratio (VSWR) lower than 2 in bandwidths 2.4-2.5 GHz and 4.9-5.83 GHz. The embodiment thus provides an antenna of reduced size and improved transmission.

Figure 5A:
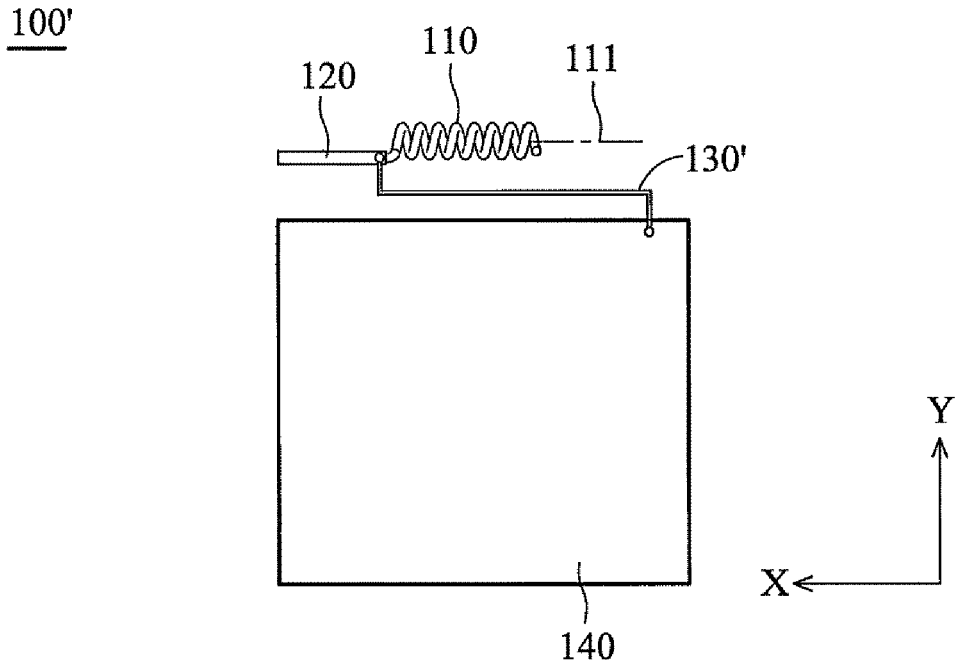
FIGS. 5*a* and 5*b* show a modified example of the first embodiment.
Figure 5B:
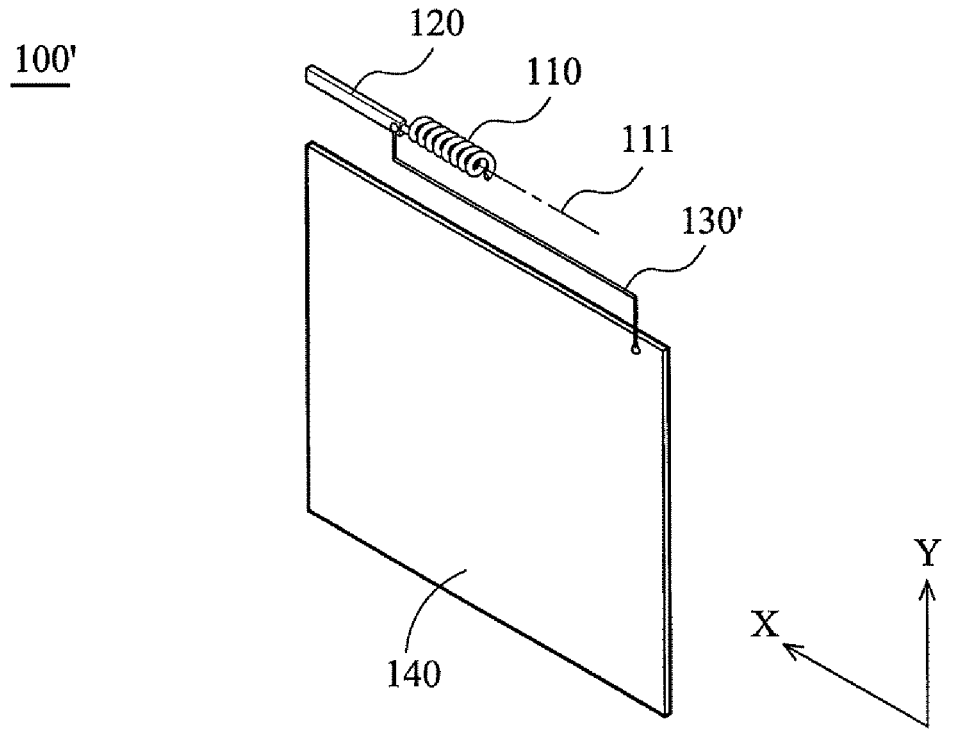

The ground element 140 is metal sheet or foil, for example, copper sheet or copper foil. The conductive element 130 is metal sheet or metal line. FIGS. 5*a* and 5*b* shows an antenna 100' of a modified example, wherein the conductive element 130' is a copper line. In another modified embodiment, the ground element and the conductive element are formed on a circuit board.

Figure 6A:
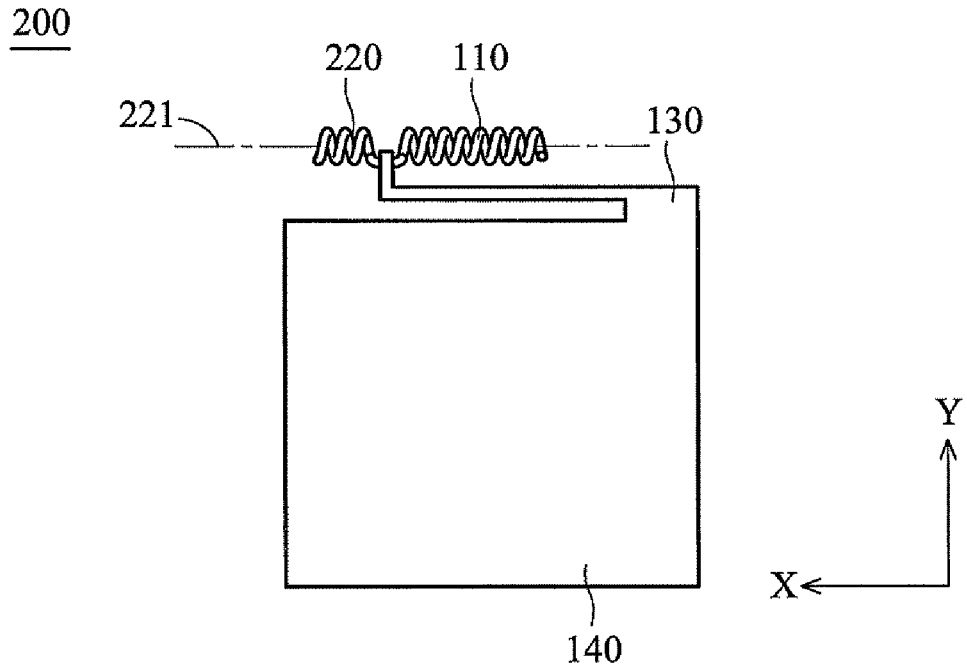
FIGS. 6*a* and 6*b* show an antenna of a second embodiment.
Figure 6B:
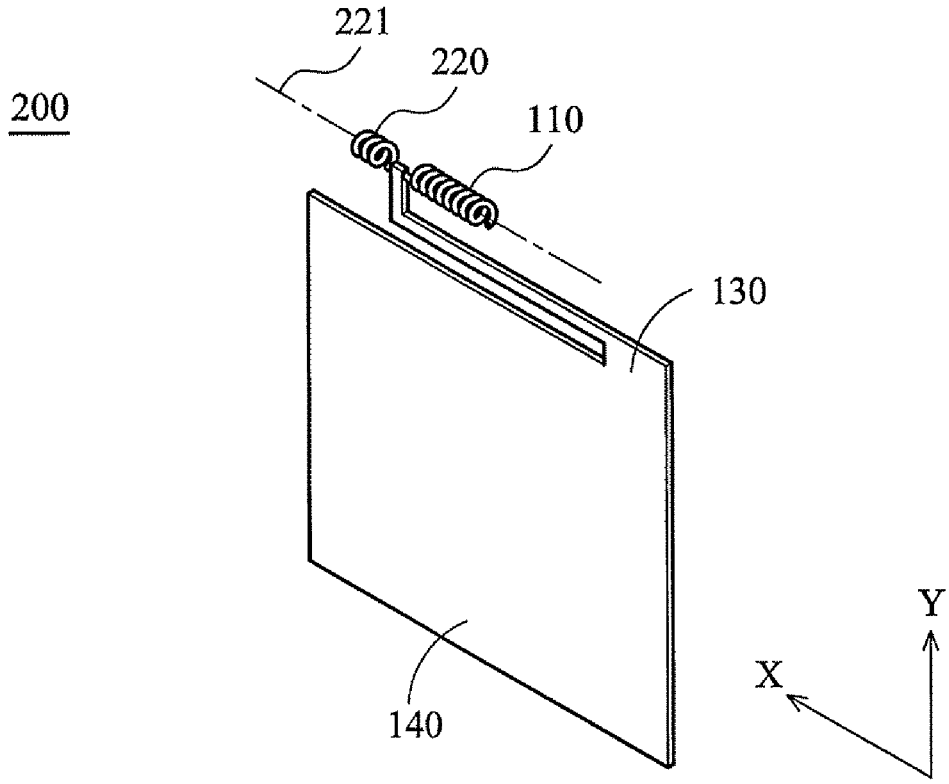

FIGS. 6*a* and 6*b* show an antenna 200 of a second embodiment, wherein the second transmission element 220 comprises a second spiral structure and a second axis 221. The wire diameter d of the second spiral structure is 0.5 mm, the thread diameter $\phi$ is 2 mm, the thread pitch P is 1 mm, and the thread number $N_2$ is 2.5. The second axis 221 extends in the second direction X.

Figure 7A:
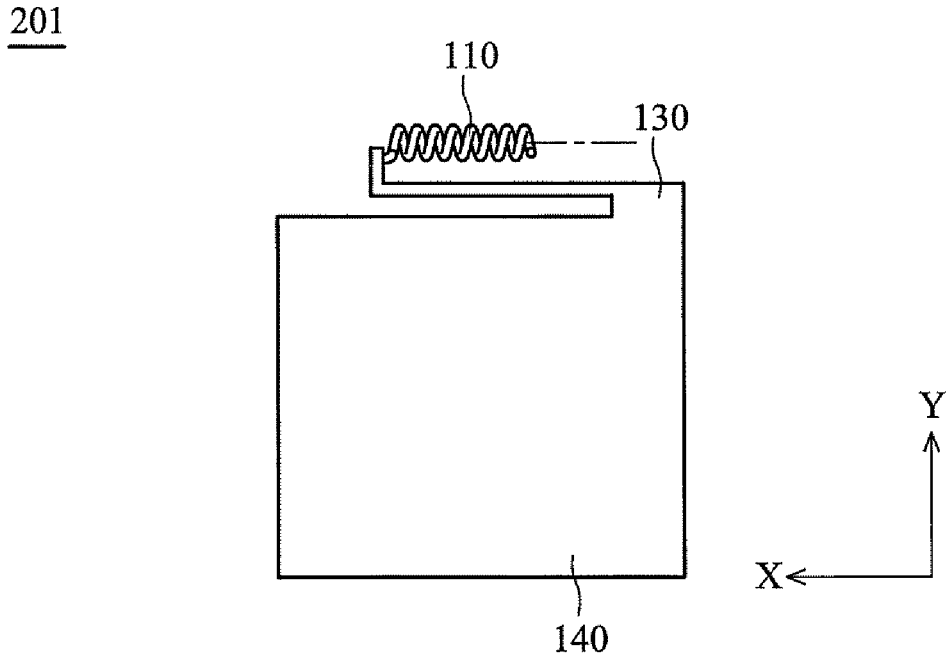
FIG. 7*a* shows a modified embodiment of the invention.

FIG. 7*a* shows an antenna 201 of a modified embodiment, wherefrom the second transmission element is omitted, and the antenna 201 transmits wireless signal via the first transmission element 110.

Figure 7B:
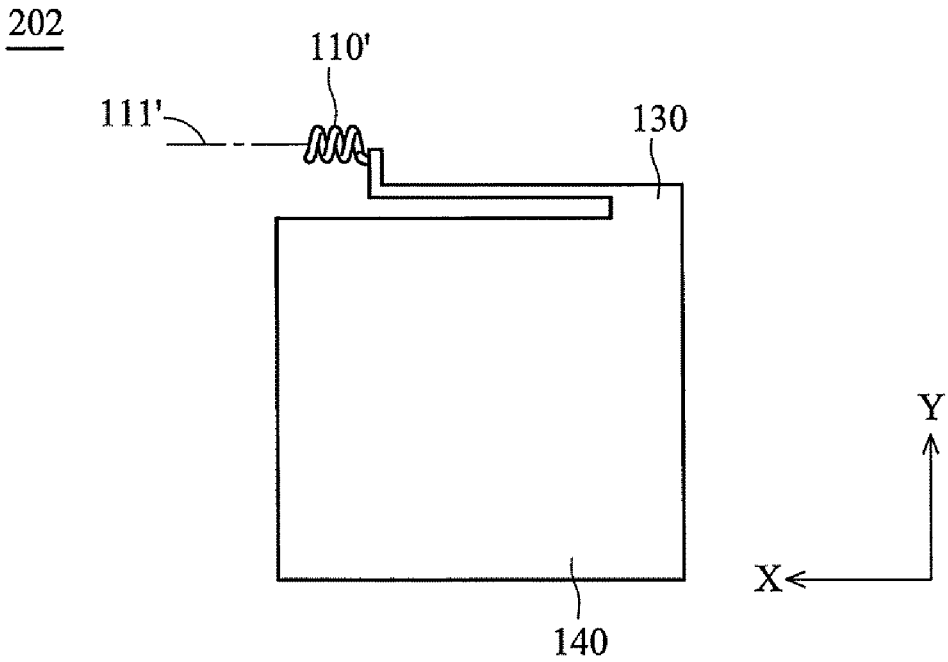
FIG. 7*b* shows another modified embodiment of the invention.

FIG. 7*b* shows an antenna 202 of another modified embodiment, wherein the first transmission element 110' comprises a first axis 111' extending in the second direction X.

Figure 7C:
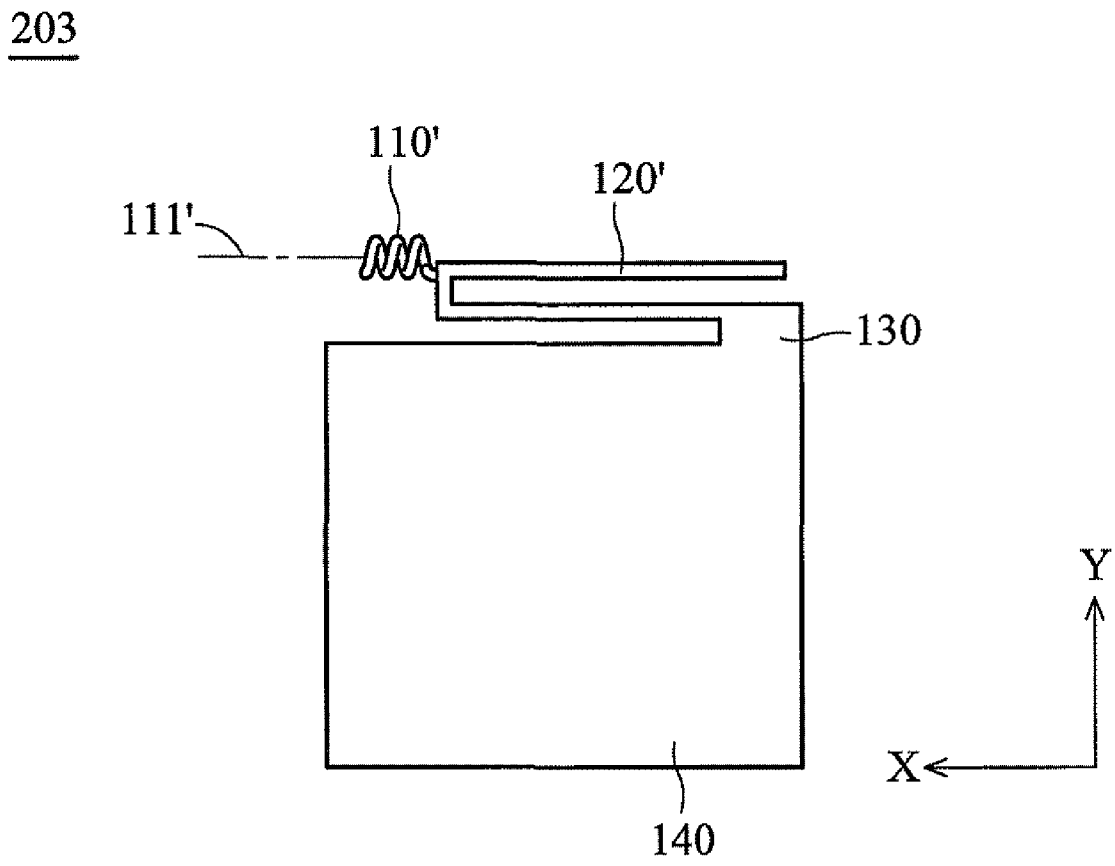
FIG. 7*c* shows another modified embodiment of the invention.

FIG. 7*c* shows an antenna 203 of another modified embodiment, wherein the second transmission element 120' is connected to the transmission element 130 extending in the third direction −X.

Figure 8A:
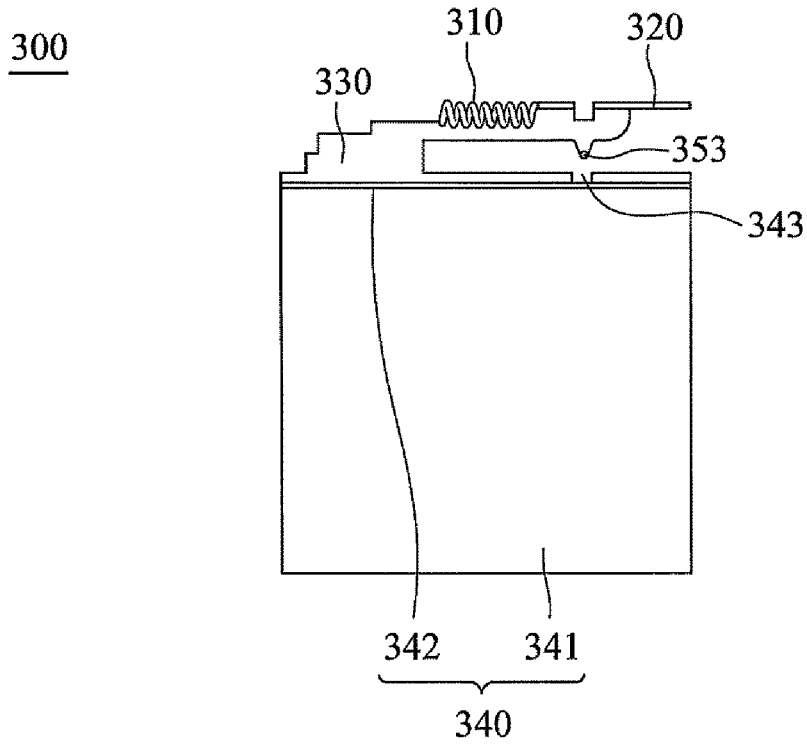
FIGS. 8*a* and 8*b* show an antenna of a third embodiment.
Figure 8B:
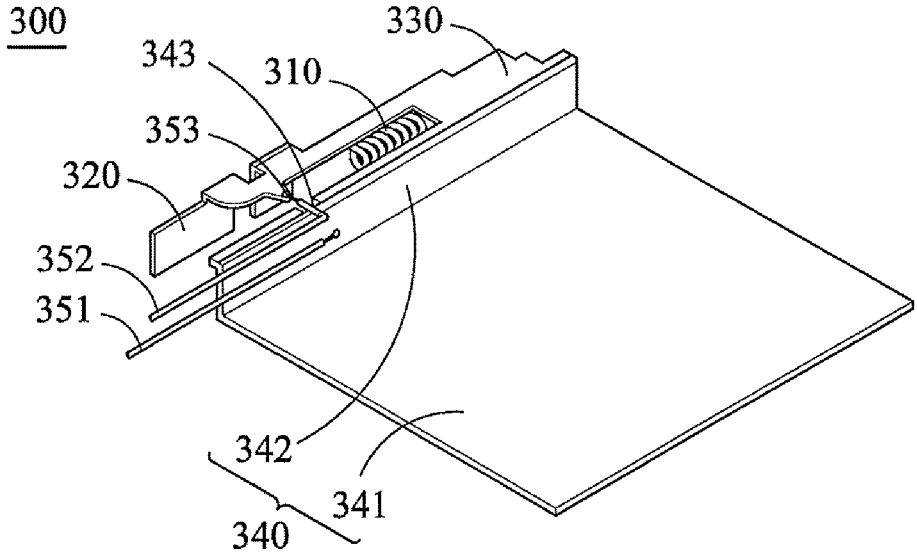

FIGS. 8*a* and 8*b* show an antenna 300 of a third embodiment comprising a first transmission element 310, a second transmission element 320, a conductive element 330, a ground element 340, a ground line 351 and a signal line 352. The first transmission element 310 is connected to the conductive element 330. The first transmission element 310 comprises a first spiral structure. The second transmission element 320 is connected to the conductive element 330. The ground line 350 is electrically connected to the ground element 340. The signal line 352 is electrically connected to the conductive element 330 on a feed point 353. The ground element 340 comprises a body 341 and a third angel portion 342. The third angled portion 342 is perpendicular to the body 341. The conductive element 330 is connected to the third angled portion 342. The conductive element 330 is parallel to the body 341. The second transmission element 320 is parallel to the third angled portion 342. The signal line 352 is connected to the feed point 353 passing an opening 343 of the third angled portion 342.

Figure 9:
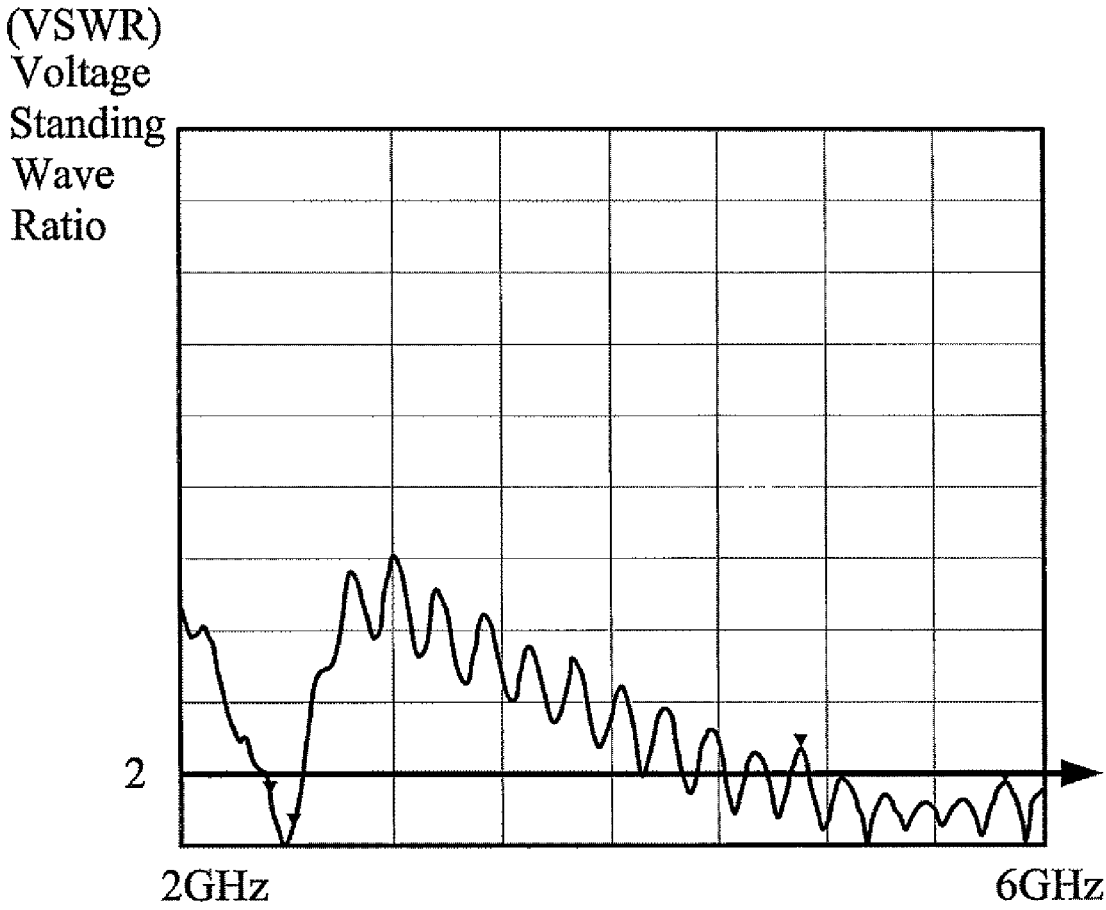
FIG. 9 shows the transmission of the third embodiment.

In the third embodiment, the wire diameter d is 0.8 mm, the thread diameter $\phi$ is 3 mm, the thread pitch P is 1.8 mm, and the thread number $N_3$ is 7. FIG. 9 shows the transmission of the antenna 300 of the third embodiment. The antenna 300 has Voltage Standing Wave Ratio (VSWR) lower than 2 in bandwidths 2.4-2.5 GHz and 4.9-5.83 GHz. The embodiment thus provides an antenna of reduced size and improved transmission.

In the embodiments, the antennas are inverse F antennas. However, the invention is not limited thereto. The spiral structure of the invention can be utilized in other antennas.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a ground element, wherein the ground element comprises a body and an extended plane connected to the body, wherein the body defines a plane that is perpendicular to the extended plane;

a conductive element, comprising a planar section connected to the extended plane, wherein the planar section is perpendicular to the extended plane and parallel to the plane defined by the body; and a first transmission element, connected to the planar section of the conductive element, wherein the first transmission element comprises a first spiral structure having a longitudinal axis, wherein the longitudinal axis of the first spiral structure is substantially parallel to the extended plane.

2. The antenna as claimed in claim 1, further comprising a second transmission element defining a plane parallel to the extended plane and perpendicular to the plane defined by the body.

3. The antenna as claimed in claim 1, wherein the ground element is a metal sheet.

4. The antenna as claimed in claim 1, wherein the ground element is foil.

5. The antenna as claimed in claim 1, wherein the conductive element is a metal sheet.

6. The antenna as claimed in claim 1, wherein the conductive element is a metal line.

7. The antenna as claimed in claim 1, further comprising a ground line electrically connected to the ground element.

8. The antenna as claimed in claim 1, further comprising a signal line electrically connected to the conductive element.

9. An antenna, comprising:

a ground element, wherein the ground element comprises a body and an extended plane connected to the body, wherein the body defines a plane that is perpendicular to the extended plane;

a ground line, electrically connected to the ground element;

a conductive element, comprising a planar section connected to the extended plane, wherein the planar section is perpendicular to the extended plane and parallel to the plane defined by the body;

a signal line, electrically connected to the conductive element; and a first transmission element, connected to the planar section of the conductive element, wherein the first transmission element comprises a first spiral structure having a longitudinal axis, wherein the longitudinal axis of the first spiral structure is substantially parallel to the extended plane.

10. The antenna as claimed in claim 9, further comprising a second transmission element defining a plane parallel to the extended plane and perpendicular to the plane defined by the body.

11. The antenna as claimed in claim 9, wherein the ground element is a metal sheet.

12. The antenna as claimed in claim 9, wherein the ground element is foil.

13. The antenna as claimed in claim 9, wherein the conductive element is a metal sheet.

14. The antenna as claimed in claim 9, wherein the conductive element is a metal line.

* * * * *